US007719399B2

(12) United States Patent
Iwasaki

(10) Patent No.: US 7,719,399 B2
(45) Date of Patent: May 18, 2010

(54) LAMINATED COIL COMPONENT

(75) Inventor: Tomohide Iwasaki, Yasu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 29 days.

(21) Appl. No.: 12/336,775

(22) Filed: Dec. 17, 2008

(65) Prior Publication Data

US 2009/0085711 A1 Apr. 2, 2009

Related U.S. Application Data

(63) Continuation of application No. PCT/JP2007/055627, filed on Mar. 20, 2007.

(30) Foreign Application Priority Data

Jun. 20, 2006 (JP) ..... 2006-170753

(51) Int. Cl.
*H01F 5/00* (2006.01)

(52) U.S. Cl. ..... 336/200

(58) Field of Classification Search ..... 336/65, 336/83, 200, 205–208, 232
See application file for complete search history.

(56) References Cited

U.S. PATENT DOCUMENTS

| | | | | |
|---|---|---|---|---|
| 6,515,568 | B1 | 2/2003 | Maki et al. | |
| 6,846,693 | B2 * | 1/2005 | Kawase et al. | 438/55 |
| 7,605,682 | B2 * | 10/2009 | Nakao et al. | 336/200 |
| 2002/0121957 | A1 | 9/2002 | Takashima et al. | |

FOREIGN PATENT DOCUMENTS

| | | | |
|---|---|---|---|
| JP | 09-7835 | A | 1/1997 |
| JP | 2005-340585 | A | 12/2005 |
| JP | 2006-303209 | A | 11/2006 |
| WO | 2005/034151 | A1 | 4/2005 |

OTHER PUBLICATIONS

Official Communication issued in International Patent Application No. PCT/JP2007/055627, mailed on Jul. 3, 2007.

* cited by examiner

*Primary Examiner*—Tuyen Nguyen
(74) *Attorney, Agent, or Firm*—Keating & Bennett, LLP

(57) ABSTRACT

A laminated coil component includes high-magnetic-permeability ferrite layers that are disposed on both main surfaces of a low-magnetic-permeability ferrite layer. Pores or pores filled with a resin are formed in the low-magnetic-permeability ferrite layer. Nickel in the high-magnetic-permeability ferrite layers does not significantly diffuse into the pores or the pores filled with the resin during firing, and thus, Ni does not readily diffuse into the low-magnetic-permeability ferrite layer.

10 Claims, 4 Drawing Sheets

LAMINATED COIL COMPONENT

BACKGROUND OF THE INVENTION

1. Field of the Invention

The present invention relates to a laminated coil component, and in particular, to an open-magnetic-circuit-type laminated coil component.

2. Description of the Related Art

Japanese Unexamined Patent Application Publication No. 2001-44037 describes an open-magnetic-circuit-type laminated coil component in which a magnetic layer is provided on both main surfaces of a non-magnetic layer to improve the direct-current superposition characteristic. However, when the non-magnetic layer and the magnetic layers are fired in a laminate, Ni included in the magnetic layers diffuses into the non-magnetic layer. More specifically, the non-magnetic layer is made of Zn—Cu ferrite and the magnetic layers are made of Ni—Zn—Cu ferrite or Ni—Zn ferrite, and thus, Ni included in the magnetic layers diffuses into the non-magnetic layer. Consequently, the non-magnetic layer into which Ni is diffused becomes a magnetic material, and thus, the thickness of the layer functioning as the non-magnetic layer decreases. This decreases the effect of improving the direct-current superposition characteristic due to the open-magnetic-circuit structure (non-magnetic interlayer structure).

A factor that affects the amount of diffusion of Ni into the non-magnetic layer is the firing temperature. Furthermore, variations in the firing temperature among production lots cause variations in the inductance characteristic of the laminated coil components and variations in the direct-current superposition characteristic. This problem becomes more serious as the size of the laminated coil component is reduced.

SUMMARY OF THE INVENTION

To overcome the problems described above, preferred embodiments of the present invention provide a laminated coil component having a satisfactory direct-current superposition characteristic by preventing the thickness of a layer functioning as a non-magnetic layer from being reduced.

A laminated coil component according to a first preferred embodiment of the present invention includes a laminate in which high-magnetic-permeability layers are disposed on both main surfaces of a low-magnetic-permeability layer, a coil disposed in the laminate, and outer electrodes that are electrically connected to the coil, the outer electrodes being disposed on the surfaces of the laminate, wherein pores are provided in at least one sub-layer defining the low-magnetic-permeability layer.

For example, the low-magnetic-permeability layer is preferably made of Zn—Cu ferrite or a non-magnetic material, for example, and the high-magnetic-permeability layers are preferably made of Ni—Zn—Cu ferrite or Ni—Zn ferrite, for example. The low-magnetic-permeability layer may preferably include a plurality of sub-layers, and among the low-magnetic-permeability sub-layers of this multilayer structure, sub-layers that are in contact with the high-magnetic-permeability layers may preferably include pores. Alternatively, two or more of the low-magnetic-permeability layers may be provided in the laminate. In addition, when the pores are filled with a resin, the strength of the laminate is improved.

In the laminated coil component according to the first preferred embodiment of the present invention, Ni in the high-magnetic-permeability layers does not significantly diffuse into the pores provided in the low-magnetic-permeability layer during firing, and thus, the pore portions function as a non-magnetic material. Furthermore, by providing pores in the low-magnetic-permeability layer, the contact area between the low-magnetic-permeability layer and another layer is decreased, and Ni in the high-magnetic-permeability layer does not readily diffuse into the low-magnetic-permeability layer during firing.

A laminated coil component according to a second preferred embodiment of the present invention includes a laminate in which magnetic layers are disposed on both main surfaces of a non-magnetic layer, a coil disposed in the laminate, and outer electrodes that are electrically connected to the coil, the outer electrodes being disposed on the surfaces of the laminate, wherein pores are provided in the magnetic layers that are in contact with the non-magnetic layer.

In the laminated coil component according to the second preferred embodiment of the present invention, by providing pores in the magnetic layers that are in contact with the non-magnetic layer, the contact area between the non-magnetic layer and each of the magnetic layers is decreased, and Ni in the magnetic layers does not readily diffuse into the non-magnetic layer during firing.

According to preferred embodiments of the present invention, by providing pores in a low-magnetic-permeability layer or by providing pores in a magnetic layer that is in contact with a non-magnetic layer, a reduction in the thickness of a layer functioning as the non-magnetic layer can be prevented, and thus, a laminated coil component having a satisfactory direct-current superposition characteristic can be obtained.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
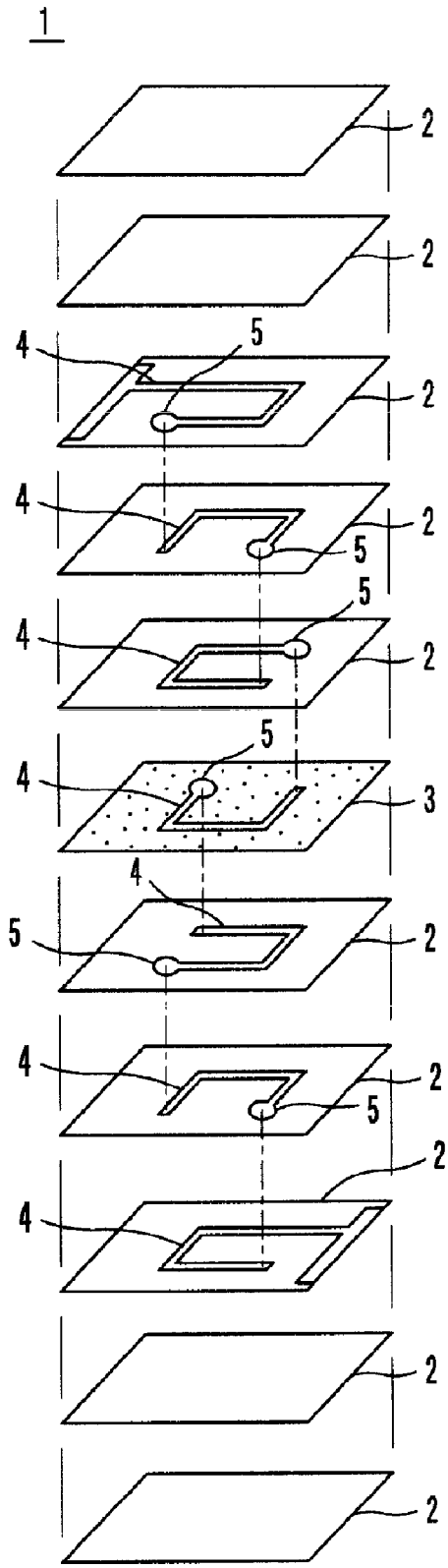
FIG. 1 includes exploded perspective views showing a laminated coil component according to a first preferred embodiment of the present invention.

Laminated coil components according to preferred embodiments of the present invention will now be described with reference to the attached drawings. Note that, in the preferred embodiments, common components and portions are denoted by the same reference numerals, and overlapping descriptions thereof are omitted.

First Preferred Embodiment

FIG. 1 shows the exploded structure of a laminated coil component 1 of a first preferred embodiment of the present invention. In the laminated coil component 1, ferrite sheets 2 in which a coil conductor 4 is provided on a surface thereof, ferrite sheets 2 in which no coil conductor is provided on a surface thereof, and a ferrite sheet 3 in which a coil conductor 4 is provided on a surface thereof are laminated.

Each of the ferrite sheets 2 is a high-magnetic-permeability ferrite sheet and is preferably made of a magnetic material such as Ni—Zn—Cu ferrite or Ni—Zn ferrite, for example. The ferrite sheet 3 is a low-magnetic-permeability ferrite sheet and is preferably made of a non-magnetic material such as Zn—Cu ferrite, for example. The low-magnetic-permeability ferrite sheet 3 is preferably prepared by adding commercially available spherical polymer particles (burn-out material) to Zn—Cu ferrite so that the ferrite sheet 3 has a predetermined porosity after firing, performing mixing, and forming the resulting mixture by a doctor blade method. The amount of spherical polymer particles added to the low-magnetic-permeability ferrite sheet 3 is preferably set in the range of about 10 to about 90 volume percent in accordance with the magnitude of a porosity required to achieve desired electrical characteristics.

Here, the ratio (volume percent) of pores formed in a sintered body is determined by the following formula.

$$\text{Porosity}=1-\{(X/Y)/Z\}$$

X: weight of sintered body

Y: volume of sintered body

Z: theoretical density of sintered body

Furthermore, holes for via-hole conductors are formed at predetermined locations of the ferrite sheets 2 and 3 with a laser beam. Subsequently, a conductive paste is applied to the surfaces by screen printing, or other suitable method, to form coil conductors 4, and a conductive paste is filled in the holes for via-hole conductors to form via-hole conductors 5.

To achieve a high Q-value of an inductor element, it is preferable that the coil conductors 4 have a low resistance value. For this purpose, a noble metal containing Ag, Au, or Pt as a main component, an alloy thereof, a base metal such as Cu or Ni, or an alloy thereof is used as the conductive paste.

A plurality of ferrite sheets 2 and 3 thus obtained are sequentially laminated and pressure-bonded to form a laminate. The coil conductors 4 are electrically connected in series through the via-hole conductors 5 to form a spiral coil.

Figure 2:
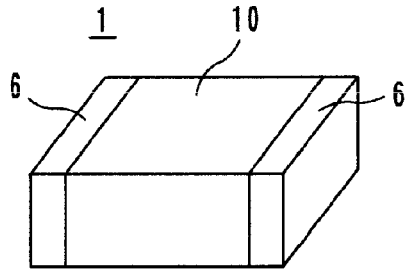
FIG. 2 is an appearance perspective view of the laminated coil component shown in FIG. 1.

The laminate is cut to a predetermined product size, debound, and then fired to obtain a sintered body 10 shown in the perspective view of FIG. 2. In this process, the spherical polymer particles added to the low-magnetic-permeability ferrite sheet 3 are burned out to form a sintered body having a predetermined porosity (preferably about 35 volume percent, for example, in this preferred embodiment).

Next, a resin is filled in the pores. Specifically, an epoxy resin is filled into the pores by immersing the sintered body 10 in a solution prepared by diluting an epoxy resin having a dielectric constant of about 3.4 with an organic solvent so as to have a predetermined viscosity. The resin adhered to the surface of the sintered body 10 is then removed. Next, the sintered body 10 is heated in the range of about 150° C. to about 180° C. for about two hours to cure the epoxy resin. The filling rate of the resin is about 10%. Filling the resin in the pores improves the strength of the sintered body 10. Accordingly, the filling rate of the resin is determined in accordance with the mechanical strength required for the sintered body 10. The filling rate of the resin is preferably in the range of about 10% to about 70%, for example, in terms of the volume ratio of the resin to the pores. When the sintered body 10 has a sufficient mechanical strength without being impregnated with a resin, a resin impregnation is not required.

Figure 3:
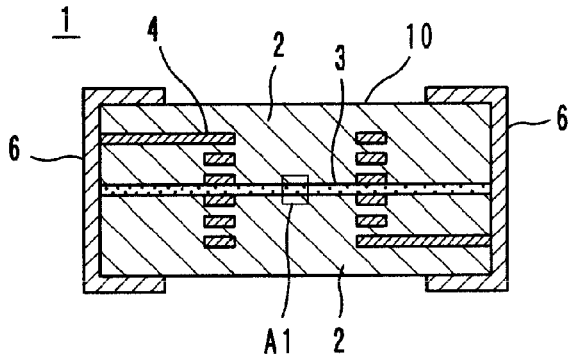
FIG. 3 is a vertical cross-sectional view of the laminated coil component shown in FIG. 2.

Next, as shown in the vertical cross-sectional view of FIG. 3, outer electrodes 6 that are electrically connected to the spiral coil formed in the sintered body 10 are preferably formed by dipping each of the ends of the sintered body 10 in a Ag/Pd (80/20) paste bath.

Figure 4:
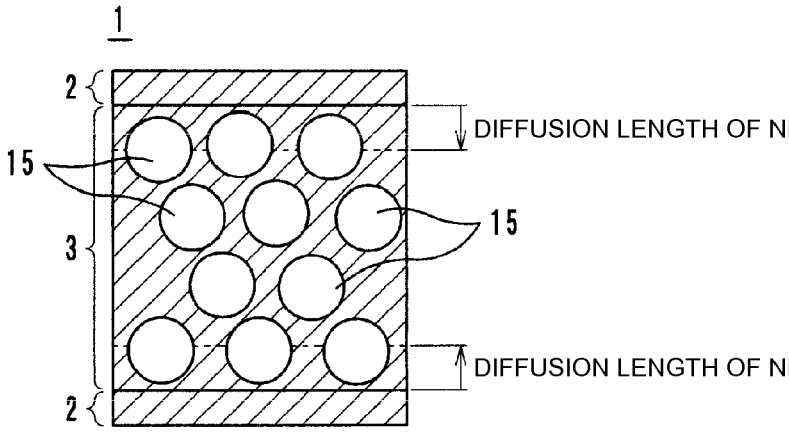
FIG. 4 is an enlarged schematic cross-sectional view of portion A1 in FIG. 3.

As shown in the enlarged schematic cross-sectional view of FIG. 4, in the open-magnetic-circuit-type laminated coil component 1, the high-magnetic-permeability ferrite layers 2 are disposed on both main surfaces of the low-magnetic-permeability ferrite layer 3. Pores 15 or pores 15 filled with the resin are formed in the low-magnetic-permeability ferrite layer 3. Nickel in the high-magnetic-permeability ferrite layers 2 does not diffuse into the pores 15 or the pores 15 filled with the resin during firing, and thus, the pores 15 or the pores 15 filled with the resin function as a non-magnetic material. Accordingly, a low-magnetic-permeability ferrite layer 3 having an effective non-magnetic region with a relatively large thickness can be obtained to improve the direct-current superposition characteristic of the laminated coil component 1.

Furthermore, the pores 15 or the pores 15 filled with the resin prevent Ni in the high-magnetic-permeability ferrite layers 2 from diffusing into the low-magnetic-permeability ferrite layer 3, thereby decreasing the diffusion length of Ni. Therefore, the effective non-magnetic region can be reliably ensured, and thus, variations in the electrical characteristics and the direct-current superposition characteristic can be suppressed.

Figure 5:
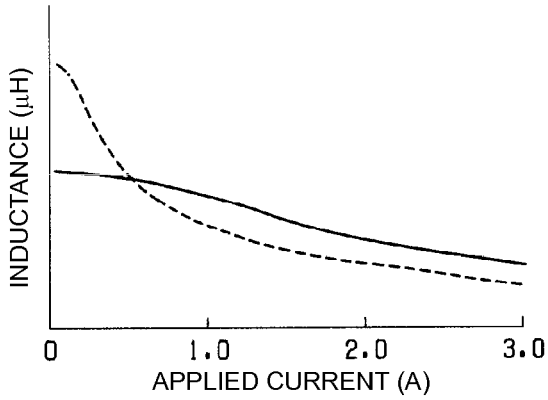
FIG. 5 is a graph showing the inductance characteristic of the laminated coil component shown in FIG. 1.

FIG. 5 is a graph showing the measurement results (the solid line) of the inductance characteristic of the laminated coil component 1. For comparison, a measurement result (the dotted line) of a known open-magnetic-circuit-type laminated coil component is also shown in FIG. 5. As shown in FIG. 5, in the laminated coil component 1 of the first preferred embodiment, even when an applied current increases, a decrease in the inductance is prevented and minimized, to thus improve the direct-current superposition characteristic.

Second Preferred Embodiment

Figure 6:
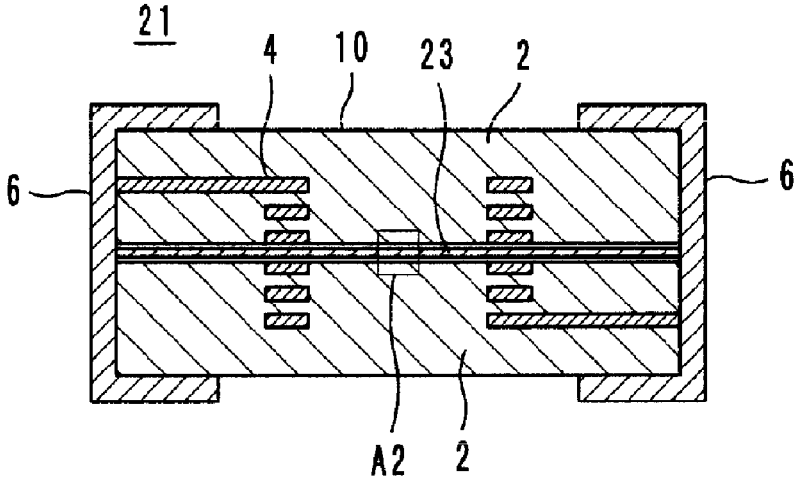
FIG. 6 is a vertical cross-sectional view of a laminated coil component according to a second preferred embodiment of the present invention.

FIG. 6 shows a vertical cross section of a laminated coil component 21 of a second preferred embodiment of the present invention. In the laminated coil component 21, a low-magnetic-permeability ferrite layer 23 having a three-layer structure is provided, instead of the low-magnetic-permeability ferrite layer 3 in the laminated coil component 1 of the first preferred embodiment.

Figure 7:
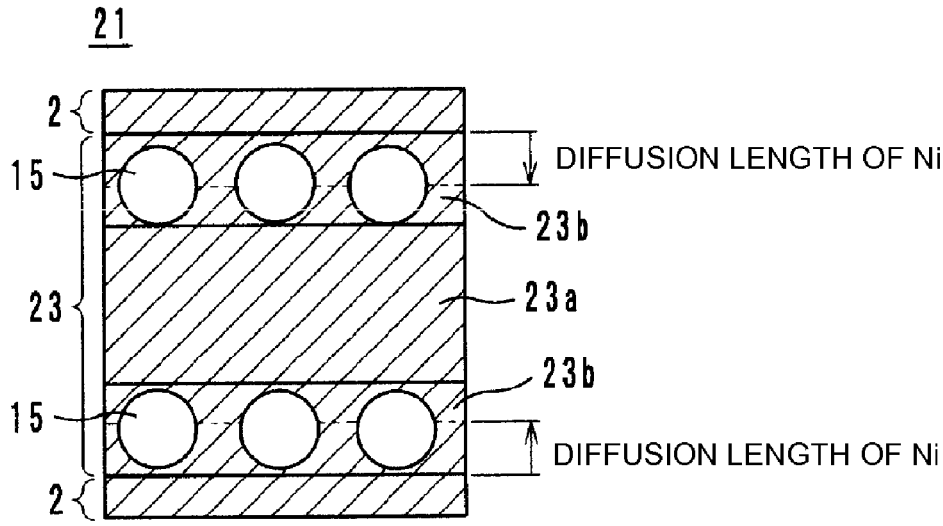
FIG. 7 is an enlarged schematic cross-sectional view of portion A2 in FIG. 6.

As shown in the enlarged schematic cross-sectional view of FIG. 7, the low-magnetic-permeability ferrite layer 23 is prepared by laminating low-magnetic-permeability ferrite sub-layers **23*b* including pores 15 or pores 15 filled with a resin on both main surfaces of a low-magnetic-permeability ferrite sub-layer 23*a* not including pores 15. The low-magnetic-permeability ferrite sub-layers 23*b* are in contact with high-magnetic-permeability ferrite layers 2**.

The laminated coil component 21 having the above-described structure has substantially the same function and advantages as those in the laminated coil component 1 of the first preferred embodiment. Furthermore, in the second preferred embodiment, since the low-magnetic-permeability ferrite layer 23 having the three-layer structure is preferably used, the direct-current superposition characteristic is improved.

In the second preferred embodiment, the thicknesses of each of the low-magnetic-permeability ferrite sub-layers 23*a* and 23*b* is less than the thickness of the high-magnetic-permeability ferrite layer, and the total thickness of the three sub-layers 23*a* and 23*b* is substantially the same as the thickness of the high-magnetic-permeability ferrite layer. Instead of providing the low-magnetic-permeability ferrite sub-layers 23*b* including pores and having a reduced thickness, all of the ferrite sub-layers may have substantially the same thickness.

Third Preferred Embodiment

Figure 8:
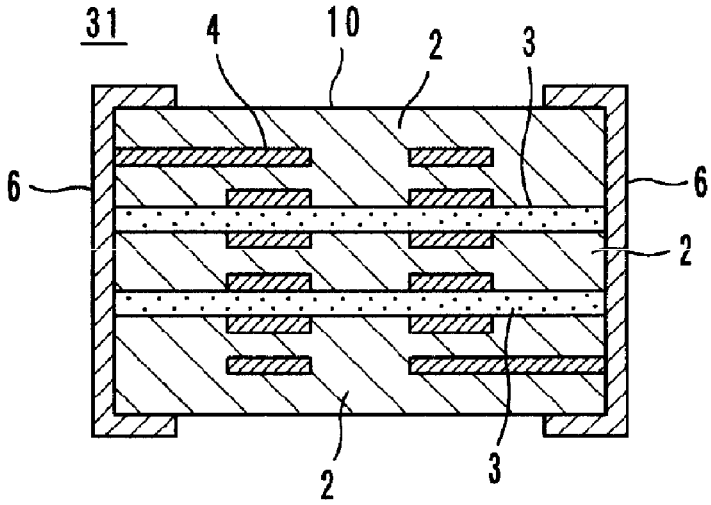
FIG. 8 is a vertical cross-sectional view of a laminated coil component according to a third preferred embodiment of the present invention.

FIG. 8 shows a vertical cross-section of a laminated coil component 31 of a third preferred embodiment of the present invention. In the laminated coil component 31, two low-magnetic-permeability ferrite layers 3 are provided in the laminate of the laminated coil component 1 of the first preferred embodiment. As described in the first preferred embodiment, each of the low-magnetic-permeability ferrite layers 3 includes pores 15 or pores 15 filled with a resin. The two low-magnetic-permeability ferrite layers 3 divide a high-magnetic-permeability ferrite region in the sintered body 10 into three portions.

The laminated coil component 31 having the above-described structure has substantially the same function and advantages as those in the laminated coil component 1 of the first preferred embodiment. Furthermore, since a plurality of low-magnetic-permeability ferrite layers 3 are provided in the laminate, the direct-current superposition characteristic is improved.

Fourth Preferred Embodiment

Figure 9:
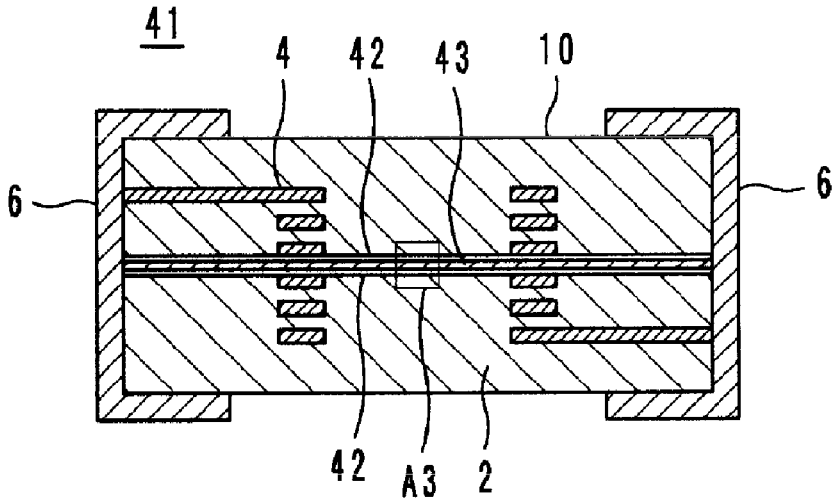
FIG. 9 is a vertical cross-sectional view of a laminated coil component according to a fourth preferred embodiment of the present invention.

FIG. 9 shows a vertical cross-section of a laminated coil component 41 of a fourth preferred embodiment of the present invention. This laminated coil component 41 includes a low-magnetic-permeability ferrite layer 43 that does not include pores 15, and high-magnetic-permeability ferrite layers 42 including pores 15 or pores 15 filled with a resin, the high-magnetic-permeability ferrite layers 42 being in contact with main surfaces of the low-magnetic-permeability ferrite layer 43. The method of forming the pores 15 in the high-magnetic-permeability ferrite layers 42 is substantially the same as the method of forming the pores 15 in the low-magnetic-permeability ferrite layer 3.

Figure 10:
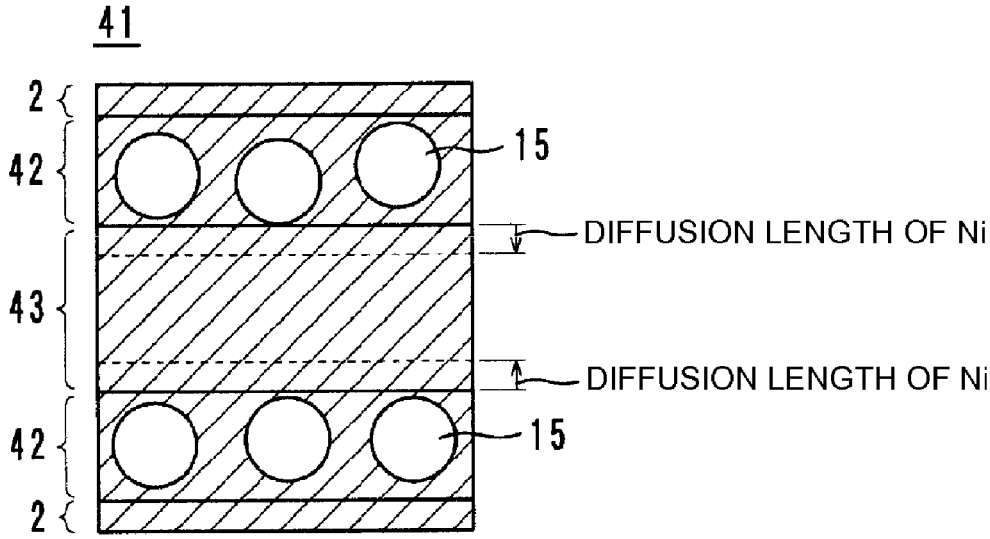
FIG. 10 is an enlarged schematic cross-sectional view of portion A3 in FIG. 9.

As shown in the enlarged schematic cross-sectional view of FIG. 10, in the open-magnetic-circuit-type laminated coil component 41, the high-magnetic-permeability ferrite layers 42 including pores 15 or pores 15 filled with a resin are provided on the main surfaces of the low-magnetic-permeability ferrite layer 43. The pores 15 or the pores 15 filled with the resin prevent Ni in the high-magnetic-permeability ferrite layers 2 and 42 from diffusing into the low-magnetic-permeability ferrite layer 43 during firing, thereby decreasing the diffusion length of Ni. Accordingly, the low-magnetic-permeability ferrite layer 43 having an effective non-magnetic region with a relatively large thickness can be obtained to improve the direct-current superposition characteristic of the laminated coil component 41.

In the fourth preferred embodiment, the thicknesses of the low-magnetic-permeability ferrite layer 43 and the high-magnetic-permeability ferrite layers 42 disposed on the main surfaces of the ferrite layer 43 are preferably relatively small, and the total thickness of the three layers 43 and 42 is substantially the same as the thickness of another single layer. Instead of providing the high-magnetic-permeability ferrite layers 42 including pores and having a small thickness, all the ferrite layers may have substantially the same thickness.

The laminated coil component according to the present invention is not limited to the above-described preferred embodiments. Various modifications can be made within the scope of the present invention.

For example, in the second preferred embodiment, among the low-magnetic-permeability ferrite sub-layers of the three-layer structure, the pres are preferably formed in the ferrite sub-layers disposed on the main surfaces. Alternatively, the pores may preferably be formed in all of the sub-layers or in the ferrite sub-layer that is not disposed on the main surfaces, for example.

As described above, preferred embodiments of the present invention are useful for a laminated coil component, and in particular, are outstanding in terms of having a satisfactory direct-current superposition characteristic.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A laminated coil component comprising:

a laminate including a low-magnetic-permeability layer and high-magnetic-permeability layers disposed on both main surfaces of the low-magnetic-permeability layer;

a coil disposed in the laminate; and outer electrodes electrically connected to the coil, the outer electrodes being disposed on surfaces of the laminate; wherein pores are provided in at least a portion of the low-magnetic-permeability layer.

2. The laminated coil component according to claim 1, wherein the low-magnetic-permeability layer is made of Zn—Cu ferrite and the high-magnetic-permeability layers are made of at least one of Ni—Zn—Cu ferrite or Ni—Zn ferrite.

3. The laminated coil component according to claim 1, wherein the low-magnetic-permeability layer includes a plurality of sub-layers.

4. The laminated coil component according to claim 3, wherein, among the plurality of low-magnetic-permeability sub-layers, sub-layers that are in contact with the high-magnetic-permeability layers include the pores.

5. The laminated coil component according to claim 1, wherein at least two of the low-magnetic-permeability layers are provided in the laminate.

6. The laminated coil component according to claim 1, wherein the low-magnetic-permeability layer is made of a non-magnetic material.

7. The laminated coil component according to claim 1, wherein the pores are filled with a resin.

8. A laminated coil component comprising:

a laminate including a non-magnetic layer and magnetic layers disposed on both main surfaces of the non-magnetic layer;

a coil disposed in the laminate; and outer electrodes electrically connected to the coil, the outer electrodes being disposed on surfaces of the laminate; wherein pores are provided in the magnetic layers that are in contact with the non-magnetic layer.

9. The laminated coil component according to claim 8, wherein the non-magnetic layer is made of Zn—Cu ferrite and the magnetic layers are made of at least one of Ni—Zn—Cu ferrite or Ni—Zn ferrite.

10. The laminated coil component according to claim 8, wherein the pores are filled with a resin.

* * * * *